US006964579B2

(12) United States Patent
Seminara et al.

(10) Patent No.: US 6,964,579 B2
(45) Date of Patent: Nov. 15, 2005

(54) POSITION ASSURED CONNECTOR

(75) Inventors: Phillip G. Seminara, Niles, OH (US); William R. Lyons, Southfield, MI (US); Cecil Brown, Detroit, MI (US); Franklin Anthony Holub, West Bloomfield, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/456,349

(22) Filed: Jun. 6, 2003

(65) Prior Publication Data

US 2004/0248475 A1 Dec. 9, 2004

(Under 37 CFR 1.47)

(51) Int. Cl.[7] ..... H01R 13/267
(52) U.S. Cl. ..... 439/352; 439/188
(58) Field of Search ..... 439/352, 353, 439/357, 188, 489, 488, 507; 200/51.09, 51.1

(56) References Cited

U.S. PATENT DOCUMENTS

| | | | | |
|---|---|---|---|---|
| 4,580,862 A | * | 4/1986 | Johnson | 439/248 |
| 4,714,433 A | | 12/1987 | Rider, Jr. | 439/310 |
| 4,906,204 A | | 3/1990 | Metzger | 439/352 |
| 5,236,373 A | | 8/1993 | Kennedy | |
| 5,241,910 A | | 9/1993 | Cunningham et al. | |
| 5,257,944 A | | 11/1993 | Kennedy | |
| 5,275,575 A | | 1/1994 | Cahaly et al. | 439/188 |
| 5,288,242 A | | 2/1994 | Muzslay | |
| 5,314,345 A | | 5/1994 | Cahaly et al. | |
| 5,456,611 A | * | 10/1995 | Henry et al. | 439/180 |
| 5,605,471 A | | 2/1997 | Plyler | 439/489 |
| 5,616,045 A | | 4/1997 | Gauker | |
| 5,681,178 A | | 10/1997 | Kunkle et al. | 439/352 |
| 5,685,743 A | | 11/1997 | Schmidt et al. | 439/701 |
| 5,688,141 A | | 11/1997 | Dullin | 439/352 |
| 5,775,930 A | | 7/1998 | Model et al. | 439/352 |

(Continued)

FOREIGN PATENT DOCUMENTS

| | | | |
|---|---|---|---|
| DE | 4317344 | A1 | 1/1994 |
| DE | 19617792 | A1 | 11/1997 |
| DE | 10032234 | A1 | 1/2002 |
| DE | 10151956 | A1 | 7/2002 |
| EP | 0112429 | A1 | 12/1982 |
| EP | 0591948 | B1 | 1/1997 |
| EP | 0591947 | B1 | 3/1997 |
| EP | 1124291 | A2 | 8/2001 |
| EP | 1130692 | A2 | 9/2001 |
| EP | 12007591 | A2 | 5/2002 |

*Primary Examiner*—Alexander Gilman
(74) *Attorney, Agent, or Firm*—Harrington & Smith, LLP

(57) ABSTRACT

An electrical connector including a housing having a receiving area for receiving a portion of a mating connector; coaxial electrical contacts connected to the housing; and a ferrite member located in the housing. The housing comprises ribs projecting inwardly into the receiving area. The ribs are adapted to allow the housing to be mated to the mating connector in at least two orientations. When the electrical connector is attached to the mating connector, the ribs are adapted to prevent rotation of the housing relative to the mating connector. The electrical connector further includes a connector position assurance (CPA) member movably attached to the housing. The CPA member includes a portion adapted to contact a section of a second one of the electrical contacts to move the section when the CPA member is moved from an unlatched position towards a latch position.

33 Claims, 14 Drawing Sheets

U.S. PATENT DOCUMENTS

| | | | | | |
|---|---|---|---|---|---|
| 5,827,083 | A | | 10/1998 | Dullin | 439/188 |
| 5,863,214 | A | | 1/1999 | Hanak | 439/352 |
| 5,895,282 | A | | 4/1999 | Little | |
| 5,924,885 | A | | 7/1999 | Pacher | 439/352 |
| 5,993,230 | A | | 11/1999 | Gauker et al. | |
| 6,004,153 | A | | 12/1999 | Myer et al. | 439/352 |
| 6,045,404 | A | | 4/2000 | Myer | 439/595 |
| 6,109,955 | A | | 8/2000 | Hanazaki et al. | 439/489 |
| 6,126,482 | A | | 10/2000 | Stabile | |
| 6,149,448 | A | | 11/2000 | Haller et al. | |
| 6,186,841 | B1 | * | 2/2001 | Jacobsson | 439/851 |
| 6,234,826 | B1 | | 5/2001 | Wilber et al. | 439/352 |
| 6,250,952 | B1 | | 6/2001 | Shiga et al. | 439/466 |
| 6,261,115 | B1 | | 7/2001 | Pederson et al. | 439/352 |
| 6,276,953 | B1 | | 8/2001 | Gauker et al. | |
| 6,290,539 | B1 | | 9/2001 | Wilber et al. | 439/595 |
| 6,328,589 | B1 | | 12/2001 | Annecke | |
| 6,354,860 | B1 | | 3/2002 | Miller et al. | 439/352 |
| 6,361,348 | B1 | | 3/2002 | Hall et al. | |
| 6,364,683 | B1 | | 4/2002 | Kohno | 439/352 |
| 6,383,036 | B1 | | 5/2002 | Steinhauser et al. | 439/752 |
| 6,406,319 | B2 | | 6/2002 | Pederson et al. | 439/352 |
| 6,419,510 | B2 | * | 7/2002 | Shiraki et al. | 439/188 |
| 6,435,895 | B1 | | 8/2002 | Fink et al. | 439/352 |
| 6,514,098 | B2 | | 2/2003 | Marpoe, Jr. et al. | 439/352 |
| 6,530,785 | B1 | | 3/2003 | Hwang | 439/76.1 |
| 6,699,059 | B2 | * | 3/2004 | Nagamine et al. | 439/352 |
| 6,743,051 | B2 | * | 6/2004 | Hayashi | 439/620 |
| 2002/0111059 | A1 | | 8/2002 | Raudenbush et al. | 439/352 |
| 2002/0115332 | A1 | | 8/2002 | Myer et al. | 439/352 |
| 2002/0137397 | A1 | | 9/2002 | Little | 439/686 |
| 2003/0049962 | A1 | | 3/2003 | Raudenbush et al. | 439/489 |

* cited by examiner

12 TEETH (±15')

15 TEETH (±12')

POSITION ASSURED CONNECTOR

BACKGROUND OF THE INVENTION

FIELD OF THE INVENTION

The present invention relates to electrical connectors and, more particularly, to an electric connector having position assurance capabilities.

BRIEF DESCRIPTION OF PRIOR DEVELOPMENTS

U.S. Pat. No. 5,944,545 discloses a single pin coaxial initiator, retainer and connector. The connector has an arcuate contact piece for contacting the spring loaded arms of the conductive ring of the initiator.

Most commercial electrical connectors used for air bag gas generators are provided as two parallel contacts with at least one ferrite tube associated with at least one of the contacts. Although this type of connector is good at preventing inadvertent discharge because of the provision of the ferrite member, there is a desire to reduce the size of electrical connectors for air bag gas generators. This is because newer vehicles will have a larger number of air bag gas generators, and some of these will be in areas of limited space, such at for a knee air bag, or a side air bag, or a seat belt pretensioner air bag. Some will also have multi-stage gas generators and, thus, multiple initiators and multiple connectors for those initiators. There is a desire to make the electrical connectors smaller and more light weight, but without a significant increase in cost.

SUMMARY OF THE INVENTION

In accordance with one aspect of the present invention, an electrical connector is provided including a housing having a receiving area for receiving a portion of a mating connector; and coaxial electrical contacts connected to the housing. The housing comprises ribs projecting inwardly into the receiving area. The ribs are adapted to allow the housing to be mated to the mating connector in at least two orientations. When the electrical connector is attached to the mating connector, the ribs are adapted to prevent rotation of the housing relative to the mating connector. The electrical connector further includes a connector position assurance (CPA) member movably attached to the housing. The CPA member includes a portion adapted to contact a section of a second one of the electrical contacts to move the section when the CPA member is moved from an unlatched position towards a latch position.

In accordance with another aspect of the present invention, an electrical connector is provided comprising a housing having a generally ring shaped receiving area for receiving a portion of a mating connector; and coaxial electrical contacts connected to the housing. The housing comprises a snap latch which is adapted to project into the mating connector and latch behind a rim of a retainer of the mating connector located in the receiving area.

In accordance with another aspect of the present invention, an electrical connector is provided comprising a housing having outwardly extending deflectable locking arms; coaxial electrical contacts connected to the housing; and a connector position assurance (CPA) member movably attached to the housing, the CPA member having locating arms in contact with the locking arms. The locking arms prevent the locating arms from moving from a first up position to a second down position unless the locking arms are at a fully connected position on a retainer rim with a mating connector.

In accordance with another aspect of the present invention, an electrical connector is provided comprising a housing; electrical contacts connected to the housing, a second one of the contacts having a deflectable shorting bar contacting a first one of the contacts; a ferrite member located in the housing; and a connector position assurance (CPA) member movably mounted to the housing between a first unlocked position and a second locked position. The CPA member has a section adapted to move the shorting bar out of contact with the first contact when the CPA member is moved from the first position towards the second position.

In accordance with another aspect of the present invention, an electrical connector is provided comprising a housing having a main section and a cover, the main section being adapted to be inserted into a receiving area of a mating electrical connector, the main section comprising a cantilevered deflectable connector position assurance (CPA) latch and the cover comprising a CPA section movably attached to a main section of the cover by a living hinge; and coaxial electrical contacts connected to the main section of the housing. The CPA latch prevents the CPA section of the cover from moving to a closed latched position unless the CPA latch is moved inward by the mating electrical connector when the CPA latch is inserted into the receiving area of the mating electrical connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
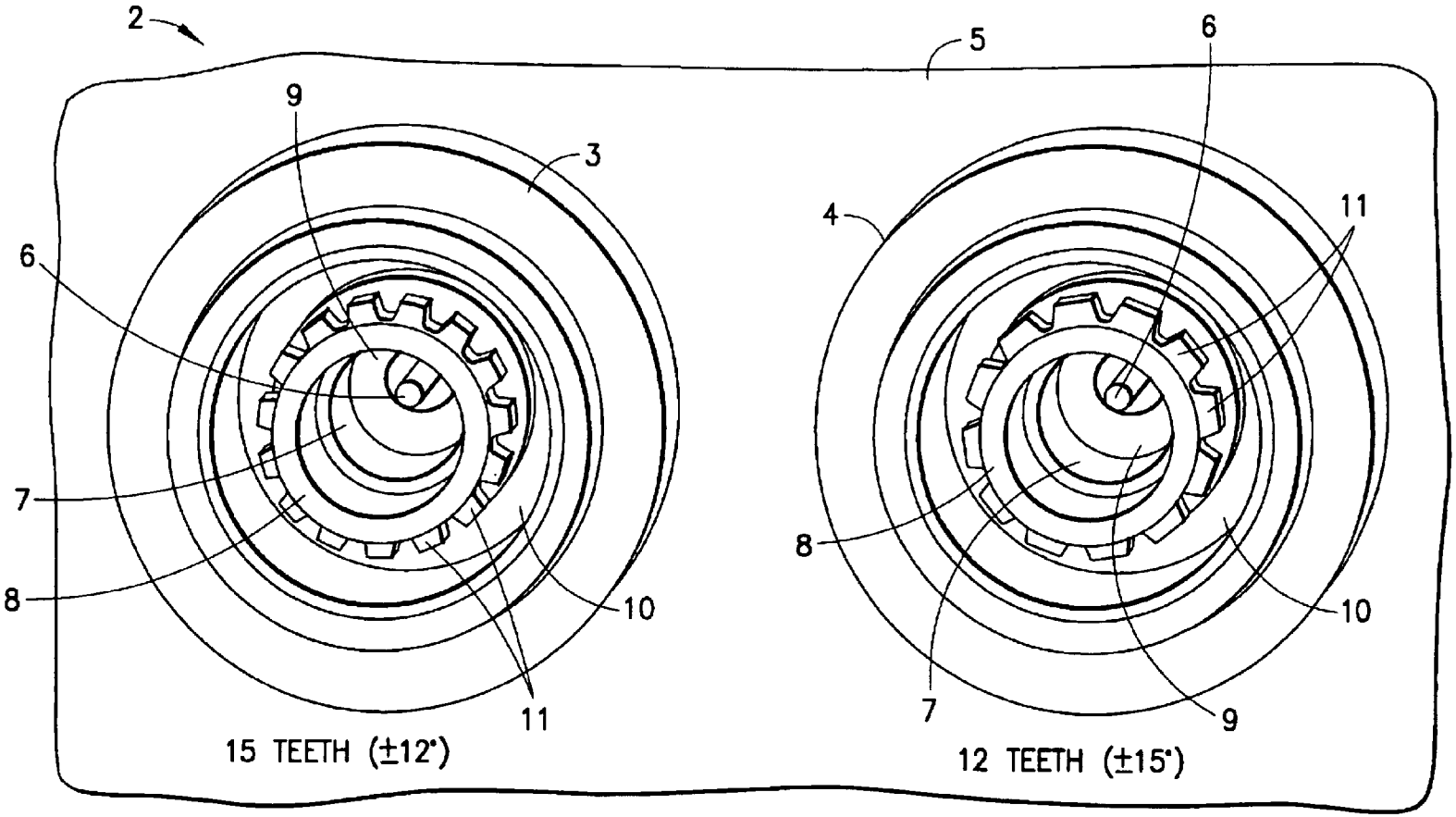
FIG. 1 is a partial perspective view of a multi-stage air bag assembly for use with electrical connectors incorporating features of the present invention.

Referring to FIG. 1, there is shown a perspective view of a portion of a multi-stage air bag assembly 2 for use with electrical connectors incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
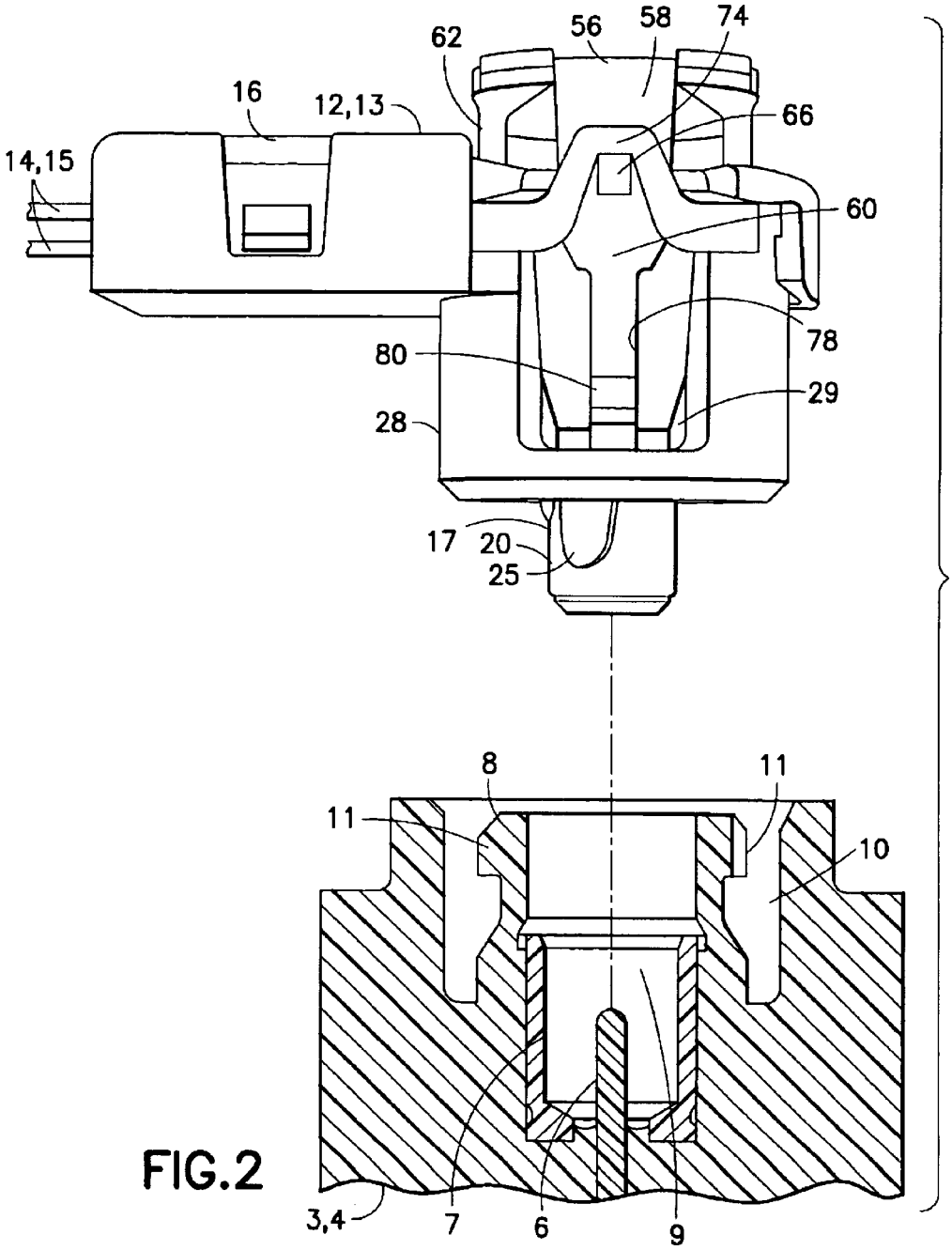
FIG. 2 is a side view of an electrical connector incorporating features of the present invention with a cutaway section of one of the initiator connectors shown in FIG. 1.

The assembly 2 generally comprises two gas generator initiators having connectors or adapters 3, 4 connected to an inflatable bag device 5, and two electrical connectors 12, 13 (see FIGS. 2 and, 10 and 11) which are mateable to the connectors 3, 4. In this embodiment, the assembly 2 is for a dual-stage gas generator device. However, features of the present invention can be used in single stage or other multi-stage gas generator devices. Referring also to FIG. 2, the electrical connectors 12, 13 are provided for connection to gas generators, such as micro gas generators used in a vehicle air bag assembly. However, the electrical connectors 12, 13 could be used to connect to any suitable type of electrical component. The electrical connectors 12, 13 are each connected to a respective pair of electrical conductors 14, 15. In alternate embodiments, the assembly could comprise more than two electrical conductors, and/or the conductors could be provided in a cable configuration.

The two gas generator initiator connectors 3, 4 each comprise a center contact pin 6, a ground contact 7, and a connector frame which includes a retainer rim 8 defining an inner receiving area 9 and an outer receiving area 10. The ground contact 7 forms an electrical contact separate from the electrical contact 6. The two contacts 6, 7 form a general coaxial connector. The retainer rim 8 comprises outwardly extending teeth or splines 11. The only difference between the retainer rim 8 of the first and second initiator connectors 3, 4 is the number of splines 11. The first initiator connector 3 has fifteen splines 11 about 12 degrees apart. The second initiator connector 4 has twelve splines about 15 degrees apart. In alternate embodiments the initiators could have any suitable number of splines and, the splines could have any suitable angle spacing. The splines 11 extend outward into the outer receiving area 10. The coaxial design of the connectors and the splines 11 on the retainer rim 8 eliminate the need for orientation of the initiator, initiator adapter connector and/or inflator during module assembly. The design allows for a multiple number of distinct fixed connector orientation and wire routing option. More specifically, the first initiator connector 3 can have the first electrical connector 12 connected to it in one of fifteen orientations. The second initiator connector 4 can have the second electrical connector 13 connected to it in one of twelve orientations.

Figure 3:
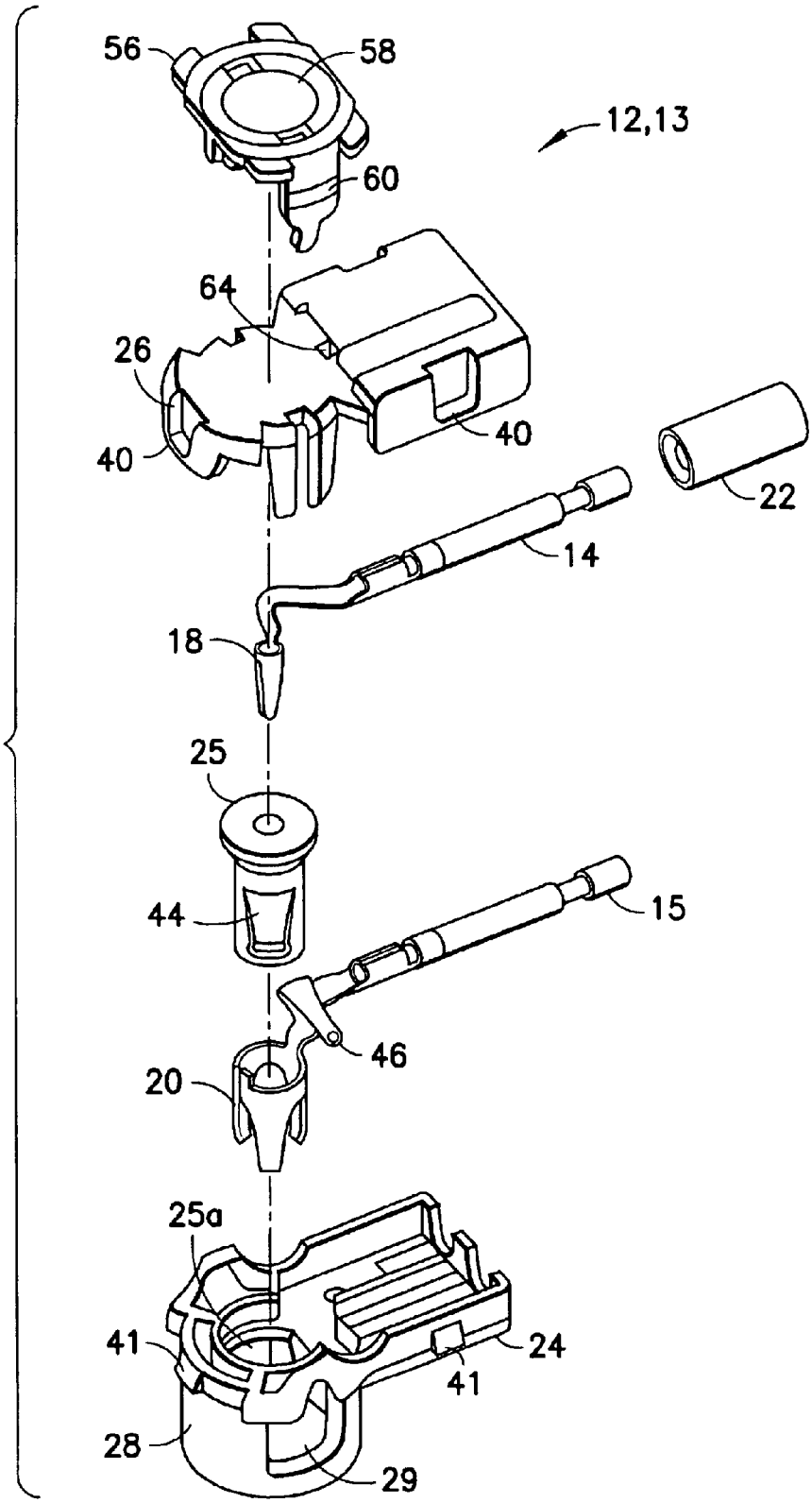
FIG. 3 is an exploded perspective view of the electrical connector shown in FIG. 2.

Referring also to FIG. 3, the first electrical connector 12 is provided as a coaxial electrical connector. The electrical connector 12 comprises a housing 16 (see FIG. 2), a power contact or terminal 18, a ground contact or terminal 20, and a ferrite member 22. In an alternate embodiment, the electrical connector could comprise additional components. The second electrical connector 13 is identical to the first electrical connector 12 except for the rib number and position as described below. The connector 12 forms a mating connector insertion section 17 (see FIG. 2) which is adapted to be inserted into the mating connector of the first gas generator initiator connector 3.

The housing 16 comprises a first housing member 24, a second housing member or cover 26, and a third housing member in the form of a column or post 25. The housing 16 forms a front insertion section 28. In the embodiment shown, the front insertion section 28 is provided on the first housing member 24. The front insertion section includes a bottom aperture therethrough. The front insertion section 28 also comprises two side apertures 29. The first and second housing members 24, 26 are adapted to be snap lock mounted to each other by snap-lock mounting sections 40, 41. When the two housing members 24, 26 are snap lock mounted to each other they capture portions of the terminals 18, 20, ferrite member 22, and conductors 14, 15 therebetween. The post 25 is also contained within the first and second housings and, supports and separates the two terminals 18, 20 relative to each other; except as noted below. The post 25 extends through an opening 25*a* in the first housing member 24.

Figure 4:
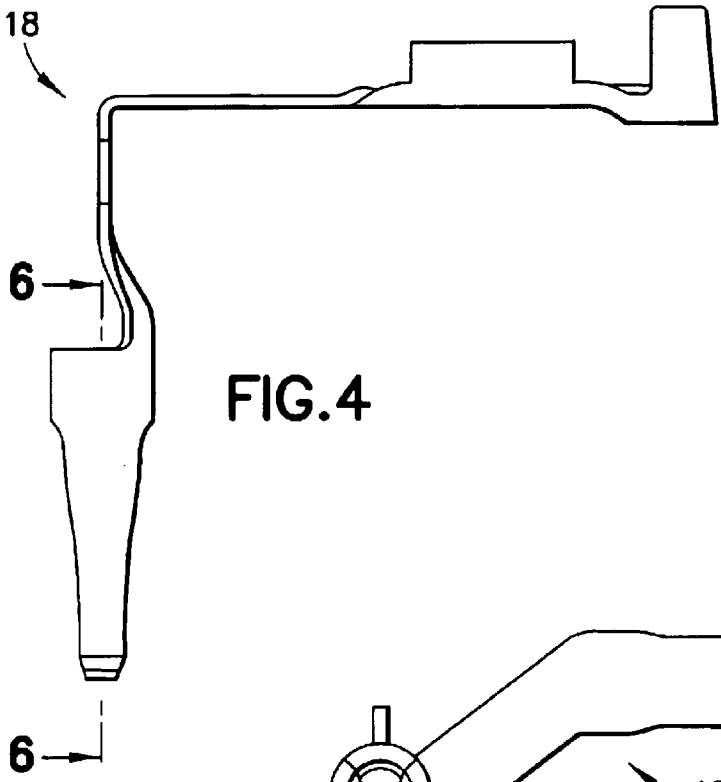
FIG. 4 is a side elevational view of the first power contact of the electrical connector shown in FIG. 3.
Figure 5:
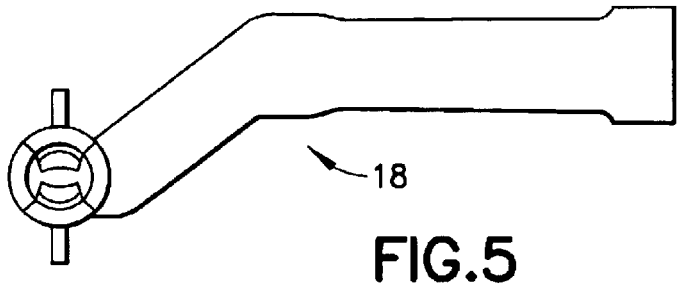
FIG. 5 is a bottom plan view of the power contact shown in FIG. 4.
Figure 6:
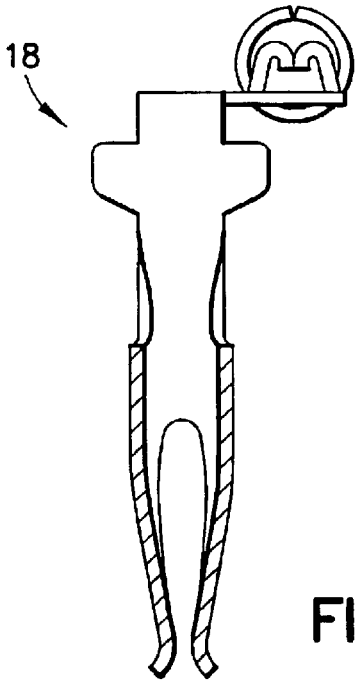
FIG. 6 is a cross sectional view of the power contact shown in FIG. 4 taken along line 6—6.

Referring also to FIGS. 4–6, the power terminal 18 is provided as a female contact. The terminal 18 is electrically and mechanically connected to the first electrical conductor 14. The terminal 18 is inserted into the post 25 such that the front entrance aperture of the terminal 18 is located aligned with the aperture of the bottom of the post 25. Any suitable type of female terminal, such as the female terminal illustrated in FIGS. 4–6, could be used.

As seen in FIG. 3, the ferrite member 22 is provided as a tubular ferrule which is located over a portion of the conductor 14. As is known in the art, the ferrite member 22 is provided to prevent an unintentional electrical signal being transmitted by the electrical conductor 14 to the power terminal 18. Any suitable type of ferrite member could be provided.

Figure 7:
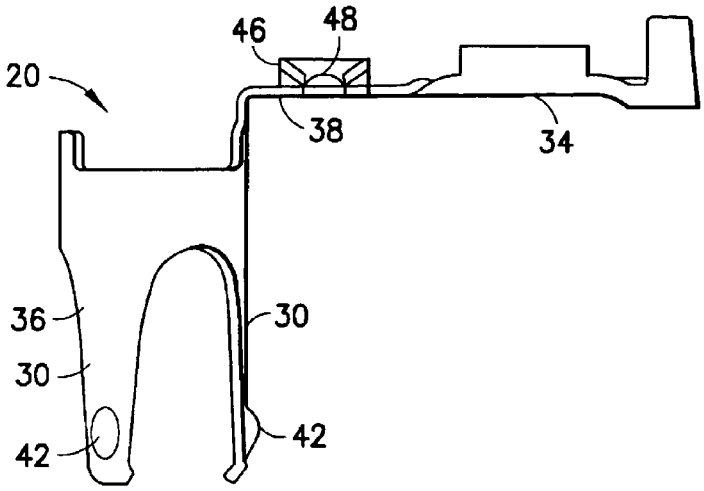
FIG. 7 is a side elevational view of the second ground contact of the electrical connector shown in FIG. 3.
Figure 8:
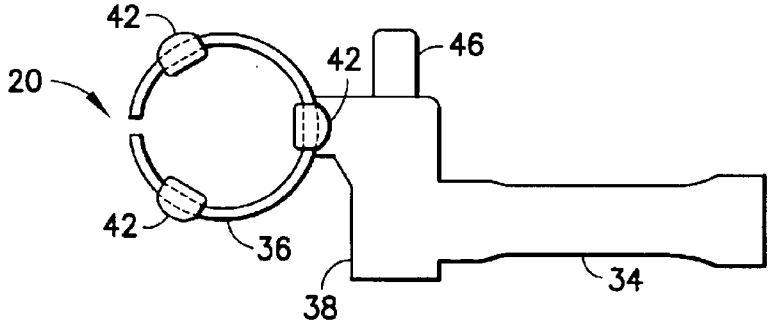
FIG. 8 is a bottom plan view of the ground contact shown in FIG. 7.
Figure 9:
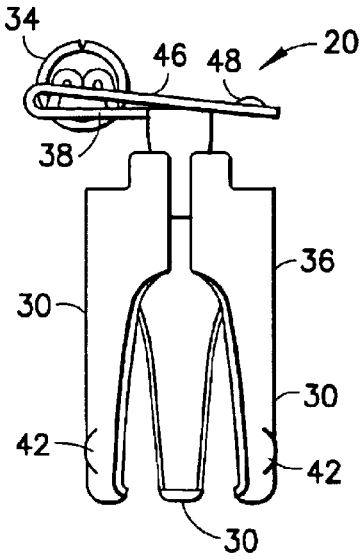
FIG. 9 is a front elevational view of the ground contact shown in FIG. 7.

Referring also to FIGS. 7–9, the ground terminal 20 generally comprises a one-piece member. Contact portions of the ground terminal 20 could be plated with a suitable plating material. The one-piece member is preferably formed from sheet metal which has been stamped and formed into the shape shown. The ground terminal 20 generally comprises a first connection section 34 and a second connection section 36. The first connection section 34 is provided for connecting the terminal to the second electrical conductor 15. In the embodiment shown, the first connection section 34 is adapted to be compressed or crimped onto the conductor 15. However, any suitable type of connection between the terminal and the electrical conductor 15 could be provided.

As seen best in FIG. 8, the second connection section 36 comprises a general circular or C shaped profile or cross-section. The second connection section 36 includes three cantilevered legs 30. Each leg 30 has an outwardly extending protrusion 42. In the embodiment shown, the second connection section 36 comprises three of the protrusions 42. In an alternate embodiment, more or less than three legs and/or protrusions could be provided. The protrusions 42 are spaced from each other along the outer side of the second connection section 36. The protrusions extend radially outward relative to a center axis of the general C shaped section.

In the embodiment shown, the protrusions 42 comprise a general rounded hill shape. However, in alternate embodiments, the protrusions 42 could comprise any suitable type of shape. For example, the front facing sides of the hill shapes could comprise elongated slopes to help with insertion of the front end of the connector 12 into the initiator connector. In order to form the protrusions 42 the sheet metal material of the second connection section 36 is stamped in an outward direction to form outward deformations of the sheet metal. As seen in FIG. 2, after the second connection section 36 is mounted to the post 25, the second connection section has its outer side freely exposed. The post 25 has three recesses 44 on its outer side to allow the legs 30 to be deflected inward towards the center axis of the post 25 when the connector 12 is inserted into the mating connector. Because it is a ground contact, the contact 20 does not need to be covered by the housing 16 and the mating connector of the gas generator initiator can cover the second connection section 36 when it is inserted into the mating connector of the gas generator initiator.

The second connection section 36 is connected to the first connection section 34 by a bridging section 38. The bridging section 38 includes a portion 46 which forms a shorting bar between the two terminals 18, 20. The shorting bar 46 is a deflectable cantilevered section with a top contact surface 48 at its end. As seen best in FIG. 17, when the two contacts 18, 20 are located in the housing, the contact surface 48 of the shorting bar 46 contacts a portion of the first contact 18 at an underside of the first contact. The shorting bar 46 electrically connects the two contacts 18, 20 with each other. However, the shorting bar 46 is movable, as described below, to electrically separate the two contacts 18, 20 from each other.

Figure 11:
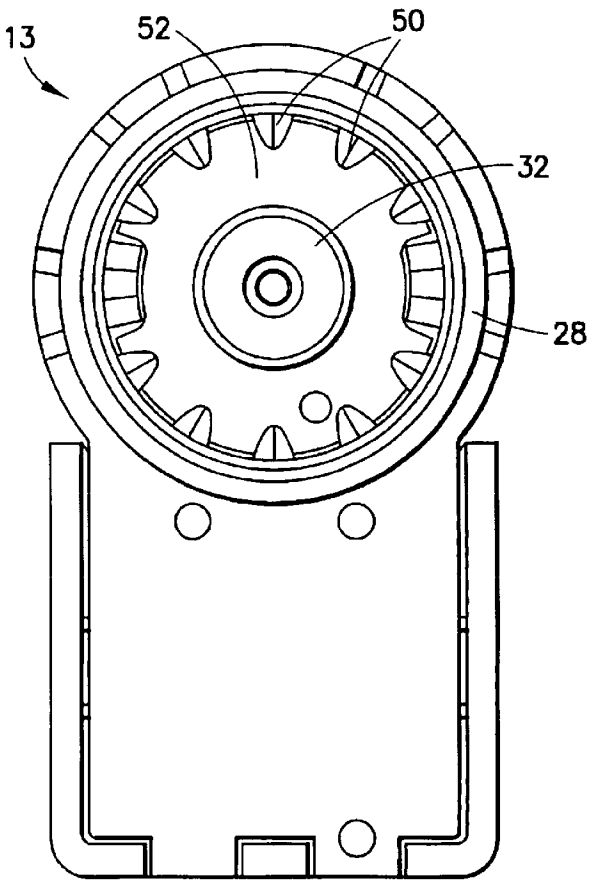
FIG. 11 is a bottom plan view of the second embodiment of the electrical connector shown in FIG. 2.
Figure 10:
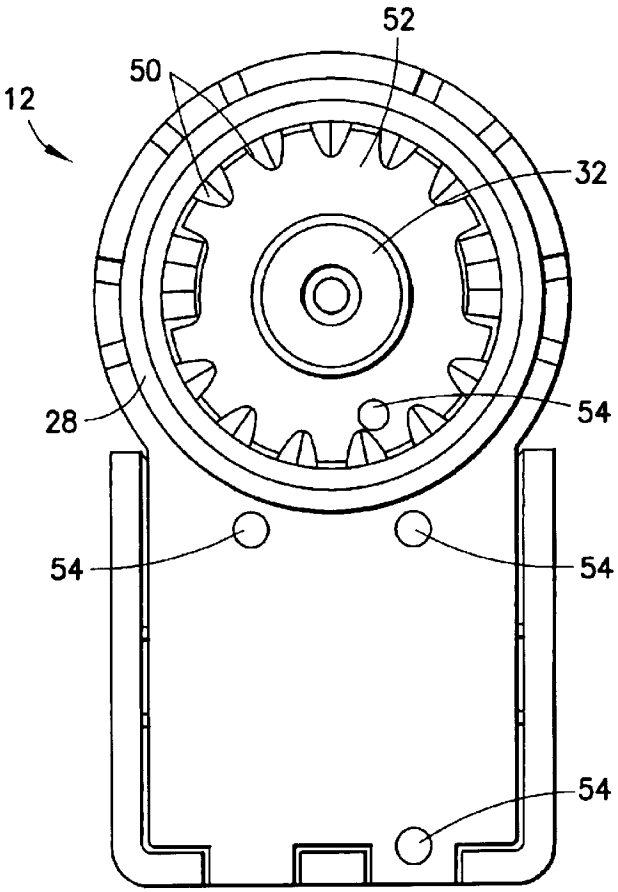
FIG. 10 is a bottom plan view of the first embodiment of the electrical connector shown in FIG. 2.

Referring also to FIGS. 10 and 11, bottom plan views of the two electrical connectors 12, 13 are shown. In this embodiment, the electrical connectors 12, 13 include pogo-pin accesses 54 for testing of the terminals 18, 20 and the shorting bar 46. The front insertion section 28 of the first housing member 24 comprises inwardly projecting teeth or ribs 50 which project into a receiving area 52. The first electrical connector 12 comprises fifteen of the ribs 50 orientated about 12 degrees apart. The number and location of the ribs 50 of the first electrical connector 12 are orientated to be received in the slots between the splines 11 of the first gas generator initiator connector 3. The second electrical connector 13 comprises twelve of the ribs 50 orientated about 15 degrees apart. The number and location of the ribs 50 of the second electrical connector 13 are orientated to be received in the slots between the splines 11 of the second gas generator initiator connector 4.

The front insertion section 28 of the electrical connectors 12, 13 are adapted to be received in the outer receiving areas 10 of the initiator connectors 3, 4. The receiving areas 52 are sized and shaped to receive the retainer rim 80 of the gas generator initiator connectors 3, 4. The inner receiving areas 9 of the gas generator initiator connectors 3, 4 are sized and shaped to receive the bottom ends of the assemblies 32 of the contacts 18, 20 and the post 25. When the contact and third housing assembly 32 is inserted into the inner receiving area 9, the power terminal 18 makes electrical connection with the center contact pin 6 and the ground terminal 20 makes electrical contact with the ground contact 7. The ribs 50 are received in the slots between the splines 11 and the splines 11 are received in the slots between the ribs 50. This prevents the electrical connectors 12, 13 from rotating relative to the initiator connectors 3, 4 after the electrical connectors have been coupled to each other. The spline/ribs configuration allow multiple connector orientations relative to each other. This design also prevents rotation after assembly.

In a preferred embodiment, the two gas generator initiator connectors 3, 4 are key coded for mechanical differentiation. More specifically, as noted above, the first connector 3 comprises fifteen teeth or splines 11 and the second connector for comprises twelve teeth or splines 11. Thus, the first electrical connector 12 cannot be connected to the second gas generator initiator connector 4. The second electrical connector 13 cannot be connected to the first gas generator initiator connector 3. This make sure that the correct electrical connector is connected to the correct gas generator initiator connector for the dual-stage application.

In addition to the mechanical differentiation, in a preferred embodiment the retainer rims 8 of the two initiator connectors 3, 4 have different colors from each other. The housings of the electrical connectors 12, 13 also have different colors from each other. The color of the first electrical connector 12 matches the color of the rim 8 of the first initiator connector 3. The color of the second electrical connector 13 matches the color of the rim 8 of the second initiator connector 4. This provides a visual color identification for quickly determining which electrical connector 12, 13 is intended to be connected to the two initiator connectors 3, 4.

Referring particularly to FIGS. 2, 3, 12, 13, and 17 the electrical connectors 12, 13 include a connector position assurance (CPA) member 56. The CPA member 56 is movably attached to the housing 16. In the embodiment shown, the CPA member 56 is a one-piece member formed from a molded plastic or polymer material. The CPA member 56 generally comprises a top section 58, two locating arms 60, and at least one cantilevered projection or rib 62.

The cantilevered projection 62 extends downward from the top section 58 at a rear side of the CPA member 56. The top side of the second housing member 26 comprises an aperture 64 to allow the cantilevered projection 62 to extend under the second housing member 26. The cantilevered projection 62 has a bottom end which forms a portion adapted to contact the top surface of the shorting bar 46 of the second electrical contact 20.

Figure 12:
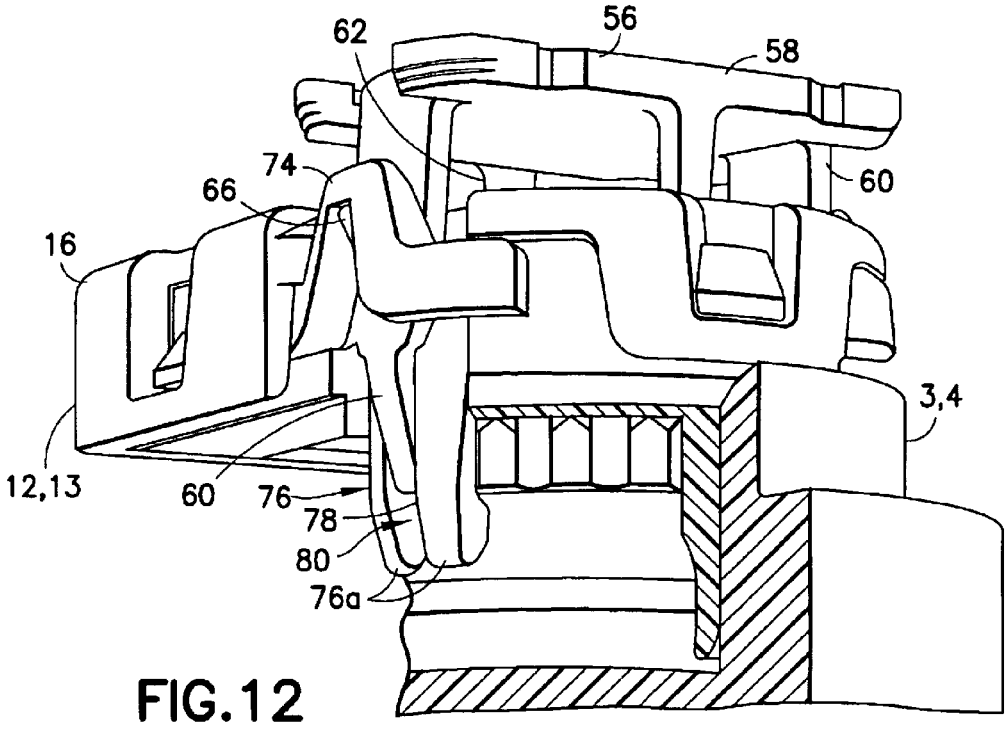
FIG. 12 is a cutaway view of the electrical connector shown in FIG. 2 shown attached to the initiator connector with the CPA member in an up position.

The two locating arms 60 extend downward from the top section 58 on opposite sides of the CPA member 56. The locating arms 60 have a deflectable cantilevered shape. The housing 16 comprises slots which the locating arms 60 extend through. Outer sides of the locating arms 60 comprise stop latches 66. The housing 16 comprises latch stops 74. FIGS. 2 and 12 show the CPA member 56 in a first up position or unlocked position. In this position, the latch stops 74 engage the stop latches 66, limit the upward position of the CPA member on the housing, and prevent the CPA member 56 from being removed from the housing 16. As seen best in FIG. 13, bottom ends of the locating arms 60 generally comprise a bottom stop surface 68, a cam surface 70, and an inward projecting section 72. The housing 16 comprises a snaps latch formed by two downwardly cantilevered locking arms or latch arms 76 located on opposite sides of the housing. The locking arms 76 each comprise a pair of arms 76*a* forming a slot 78 between them. The slot 78 is provided for the locating arms 60 of the CPA member 56 to slide along. The locking arms 76 comprise stops 80 located at the bottom portions of the slots 78. The pairs of arms 76*a* are spaced to be received in slots on opposite sides of one of the splines as the connector 12, 13 is initially being mounted to the mating connector 3, 4. In other words, the arms stratal one of the splines. The location of the arms 76*a* in the slots positions the connector housing at a predetermined fixed position on the mating connector to align the ribs relative to the splines for subsequent mating, and to align the inward projecting section 72 on the spline.

Figure 15:
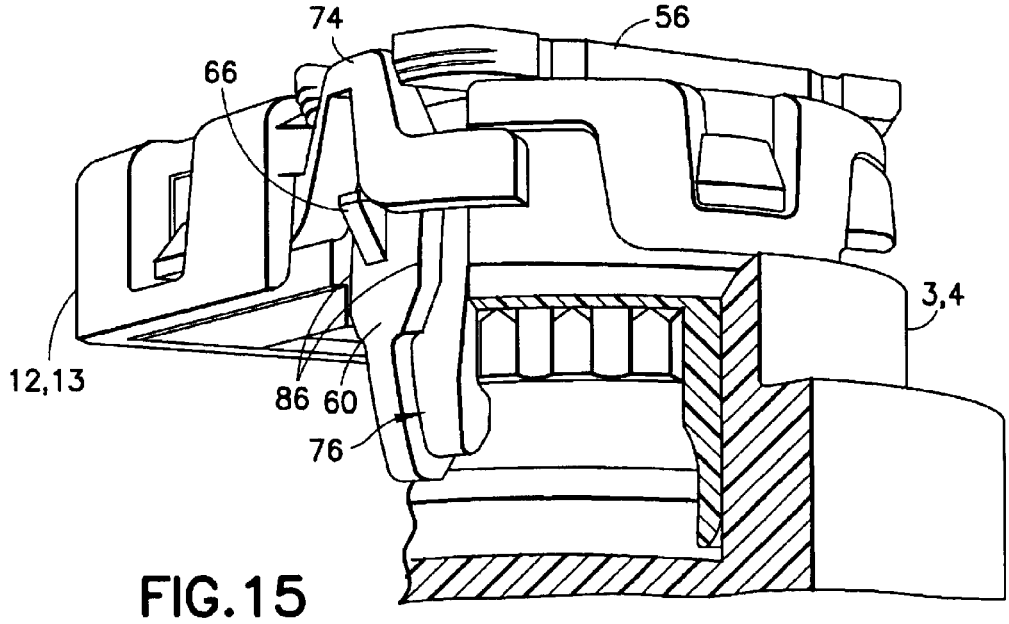
FIG. 15 is a cutaway view as in FIG. 12 with the CPA member moved to a down and latched position.
Figure 13:
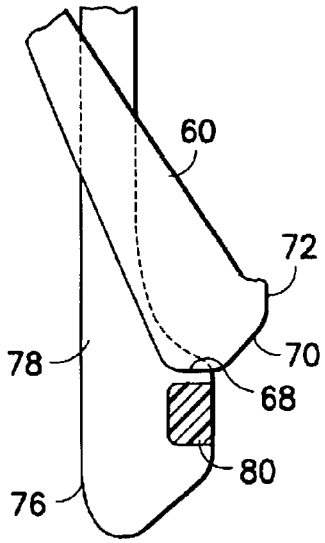
FIG. 13 is a partial cross sectional view showing a locating arm of the CPA member and a locking arm of the housing at the position shown in FIG. 12, but before connection to the initiator connector.

Referring now also to FIGS. 13-16, the CPA member 56 is movable from its first up position shown in FIGS. 2 and 12 to a second down latched position or locked position as shown in FIG. 15. However, the CPA member 56 can only be moved from the first position to the second position after the electrical connector 12, 13 has been properly attached to its respective initiator connector 3, 4. More specifically, as shown in FIG. 13, in the first position the bottom stop surface 68 of the locating arms 60 are located above the stops 80 on the locking arms 76. The stops 80 prevent the locating arms 60 from being moved downward along the slots 78.

Figure 14:
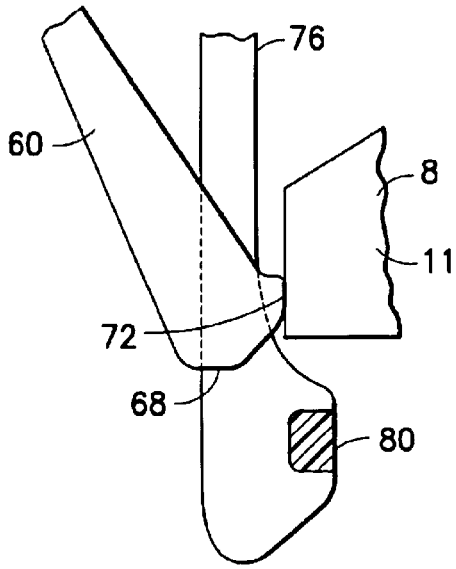
FIG. 14 is a partial cross sectional view as in FIG. 13 showing the locating arm of the CPA member and the locking arm of the housing at the position shown FIG. 12 attached to the retainer rim of the initiator connector.

As shown in FIG. 14, after the electrical connectors are properly attached to the initiator connectors the bottom ends of the locking arms 76 latch beneath the retainer rim 8. The splines 11 are located above the stops 80 and contact the innward projecting sections 72 of the locating arms 60 to deflect the bottom ends of the locating arms 60 in the outward directions. Contact of the locating arms 60 with the retainer rim 8 moves the bottom stop surfaces 68 of the locating arms 60 away from the stops 80. A user can now press on the top section 58 of the CPA member 56 to move the CPA member from its first up position to its second down position. The bottom of the locating arms 60 pass beneath the stops 80. The cam surface 70 can help deflect the locating arms 60 past the stops 80.

Figure 16:
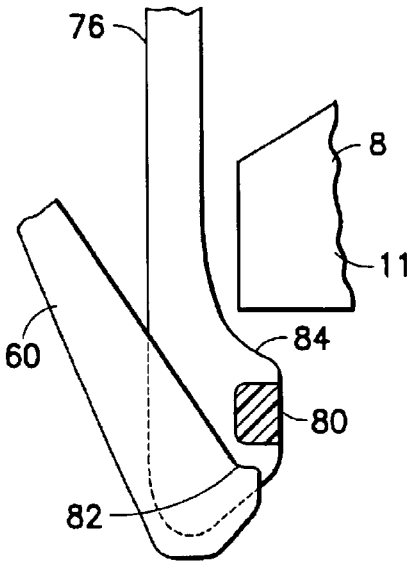
FIG. 16 is a partial cross sectional view as in FIG. 14 showing the locating arm of the CPA member and the locking arm of the housing at the position shown in FIG. 15.

As shown in FIG. 16, at the second down position the bottom of the locating arms 60 latch beneath the stops 80. However, the top surface 82 of the bottom of the locating arms 60 has a curved shape such that the CPA member 56 can be moved back to its first up position for servicing of the electrical connector with the top surface 82 function as a cam to deflect the locating arms 60 past the stops 80. When the CPA member 56 is located at its second down position, enlarged side portions 86 (see FIG. 15) of the locating arms 60 are moved down along the exterior sides of the locking arms 76. This increases the stiffness of the locking arms 76 to help prevent the locking arms from deflecting outward and unintentionally unlatching from the retainer rim 8 while the CPA member 56 is in its down, latched position. When the CPA member 56 is moved back to its up position as shown in FIG. 12, such as for servicing of the electrical connector, the electrical connector can be pulled off of the retainer rim 8 with the top surface 84 of the bottom end of the locking arms 76 functioning as cams to resiliently deflect the bottom ends of the locking arms past the splines 11 of the retainer rim 8.

Figure 17:
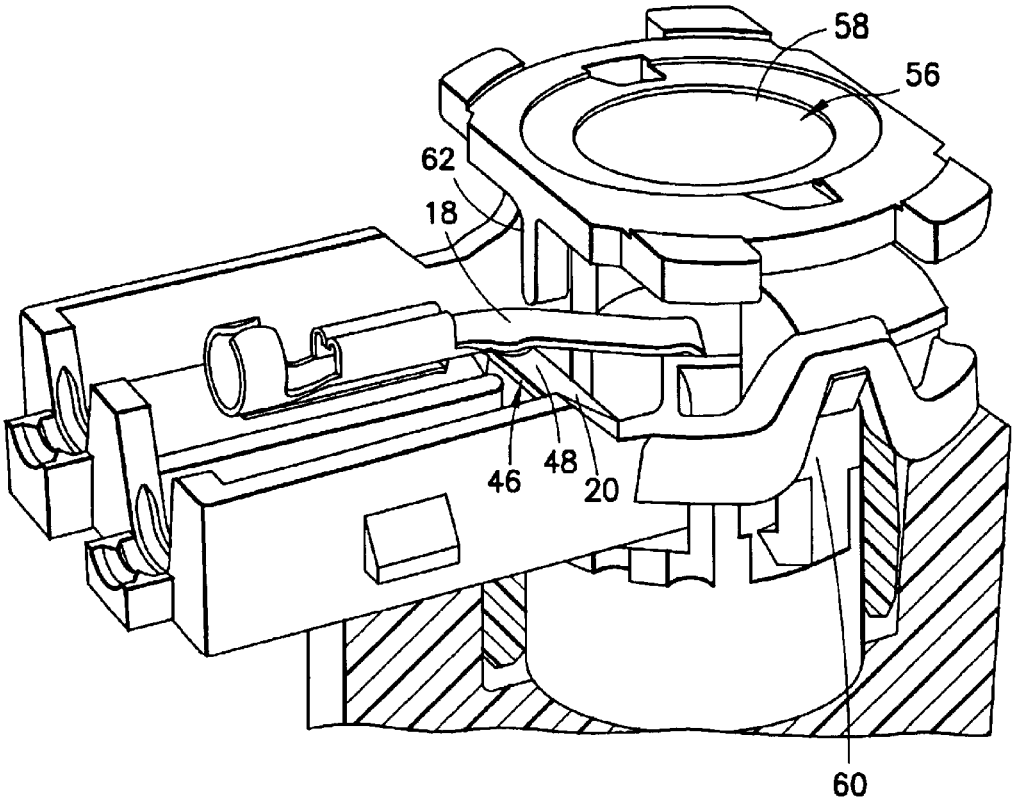
FIG. 17 is a cutaway perspective view of the electrical connector with the CPA member at the position shown in FIG. 12.
Figure 18:
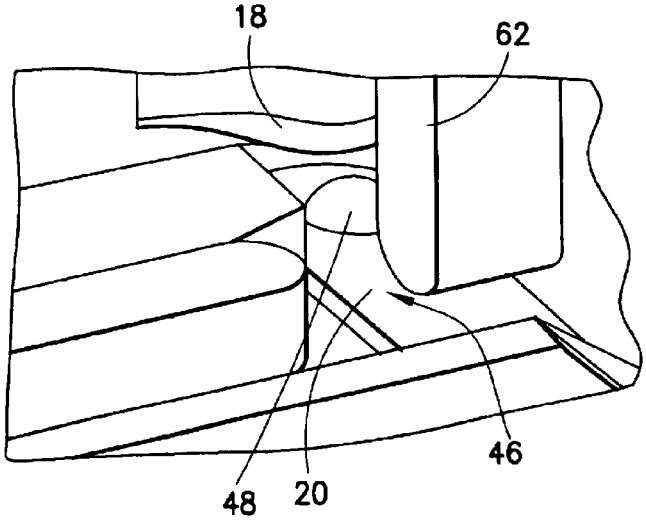
FIG. 18 is a partial perspective view of the contacts and the CPA contact moving rib when the CPA member is at the down position as shown in FIG. 15.

Referring now particularly to FIGS. 17 and 18, FIG. 17 shows the CPA member 56 in its up position. In this up position the cantilevered projection 62 is spaced from the shorting bar 46 of the second contact 20. FIG. 18 shows the position of the cantilevered projection 62 after the CPA member 56 has been moved to its down position. In this position the bottom surface of the cantilevered projection 62 contacts the top surface of the shorting bar 46 and deflects the shorting bar downward in a general cantilever fashion. This moves the top contact surface 48 of the shorting bar 46 away from contact with the first electrical contact 18. Thus, electrical shorting between the two contacts 18, 20 is interrupted by the CPA member 56 when the CPA member is moved to its down latched position. The shorting bar 46 and projection 62 on the CPA member form a switch for switching direct electrical contact between the two electrical contacts ON and OFF; based upon the position of the CPA member.

Figure 19:
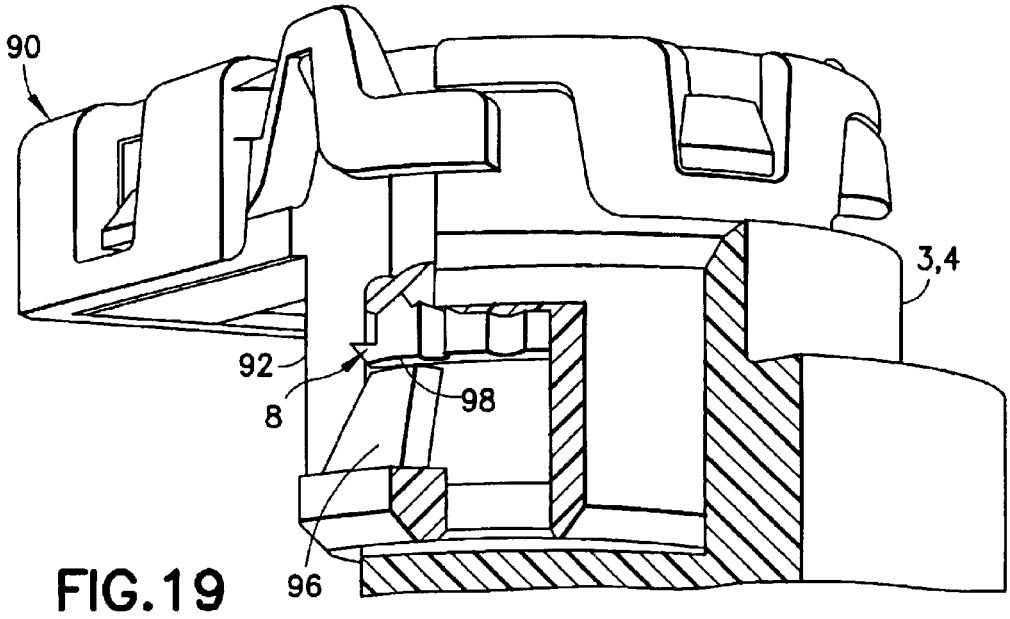
FIG. 19 is a perspective view of an alternate embodiment of the electrical connector with a cutaway section shown attached to one of the initiator connectors.

Referring now to FIG. 19, a cutaway view of an alternate embodiment of the electrical connector is shown attached to one of the initiator connectors 3, 4. In this embodiment the electrical connector 90 does not comprise a CPA member. The electrical connector 90 is not intended to be a serviceable connector such as the connectors 12, 13. Instead, the electrical connector 90 is a non-serviceable electrical connector which is intended to be disposed of after use. The electrical connector 90 shares many same members as the electrical connectors 12, 13. More specifically, the electrical connector 90 includes the two contacts 18, 20, the posts 25, the second housing member 26 and the ferrite member 22. However, the electrical connector 90 comprises a different first housing member 92 and the second electrical connector 20 does not comprise a shorting bar. The first housing member 92 includes two locking arms 94 similar to the locking arms 76. Locking arms 94 are adapted to snap lock latch beneath the retainer rim 8 of the initiator connectors 3, 4. The locking arms 94 include a latch projection 96 having a top latch surface 98 which is adapted to engage the bottom surface of the splines 11. The locking arms 94 are resiliently deflectable when mounting over the splines 11 of the retainer rim 8. Once the electrical connector 90 is attached to the initiator connector 3, 4 the electrical connector is not intended to be removed. One of the features of the present invention is the standardized interface for both serviceable and non-serviceable connector applications.

Figure 20:
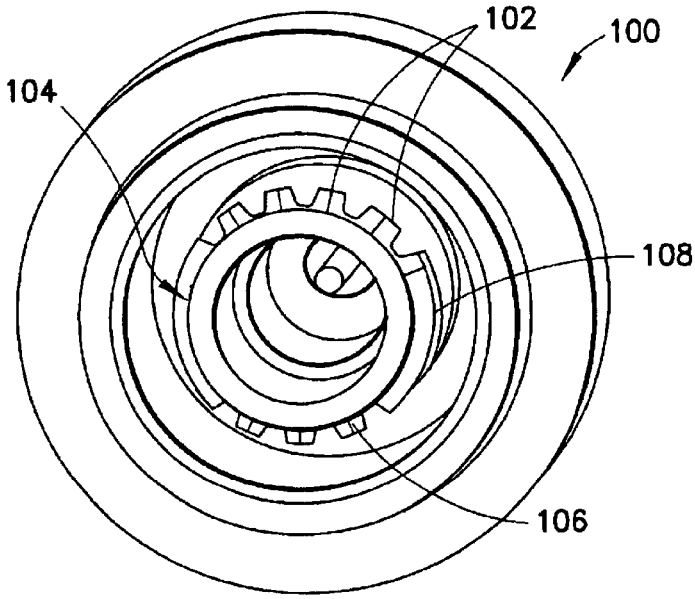
FIG. 20 is a perspective view of an alternate embodiment of the initiator connector.

Referring now to FIG. 20, a perspective view of an alternate embodiment of an initiator connector 100 is shown. The initiator connector 100 is substantially identical to the initiator connectors 3, 4 except for the configuration of the teeth or splines 102 on the retainer rim 104. More specifically, the retainer rim 104 comprises two different types of splines; a first type of spline 106 and a second type of spline 108. The second type of spline 108 is larger than the first type of spline 106. The two second types of splines 108 are orientated 180 degrees apart. The two different types of splines form a fixed orientation retainer. The mating electrical connector would comprise mating ribs and spaces between the ribs for mating with the spines 106, 108 of the initiator connector 100. In this embodiment, the retainer rim 104 allows a mating electrical connector to be connected in only two orientations; 180 degrees apart. In an alternate embodiment, the teeth or spines of the initiator connector could provide more or less than two possible connector orientations. In alternate embodiments, any suitable type of orientation limiting keying structure could be provided.

Figure 21:
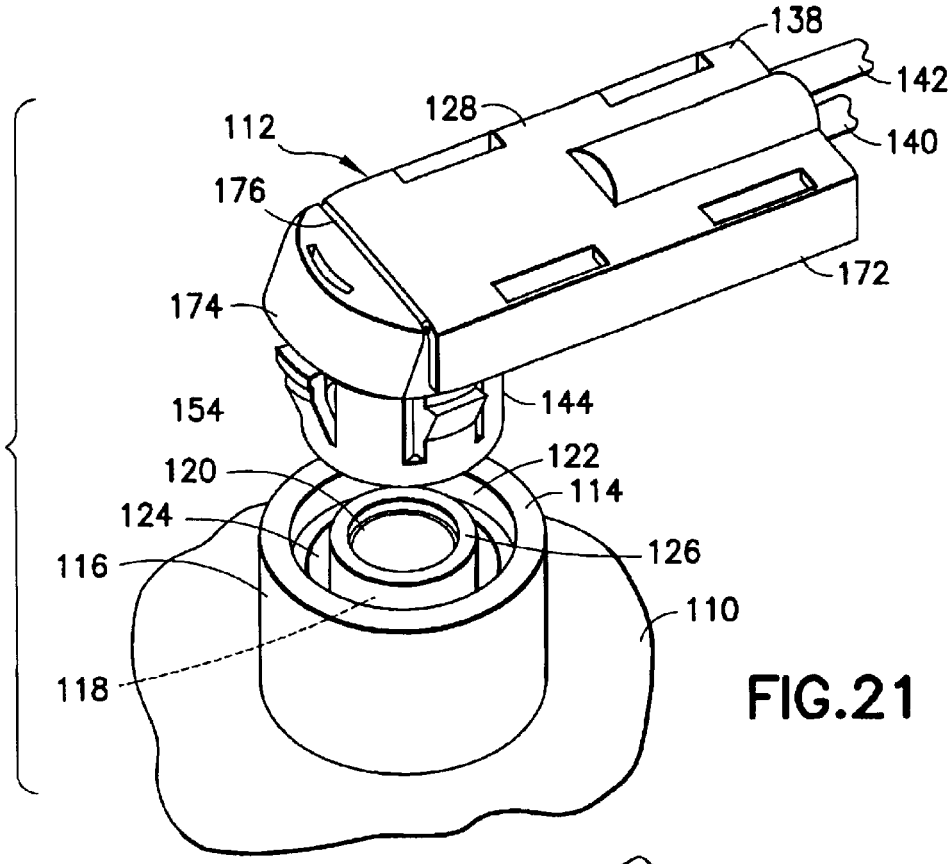
FIG. 21 is a perspective view a portion of an air bag assembly and an alternate embodiment of an electrical connector incorporating features of the present invention.

Referring now to FIG. 21, a perspective view of a portion of an air bag assembly 110 and an electrical connector 112 incorporating features of the present invention is show in a position about to be connected with a mating connector 114 of the air bag assembly 110. The mating electrical connector 114 generally comprises a housing 116, and two electrical contacts 118, 120. The housing 116 comprises two receiving areas 122, 124. The second receiving area 124 comprises a ring surrounding the first receiving area 122 with a portion 126 of the housing therebetween. The two receiving areas 122, 124 thus a form coaxial receiving area.

Figure 22:
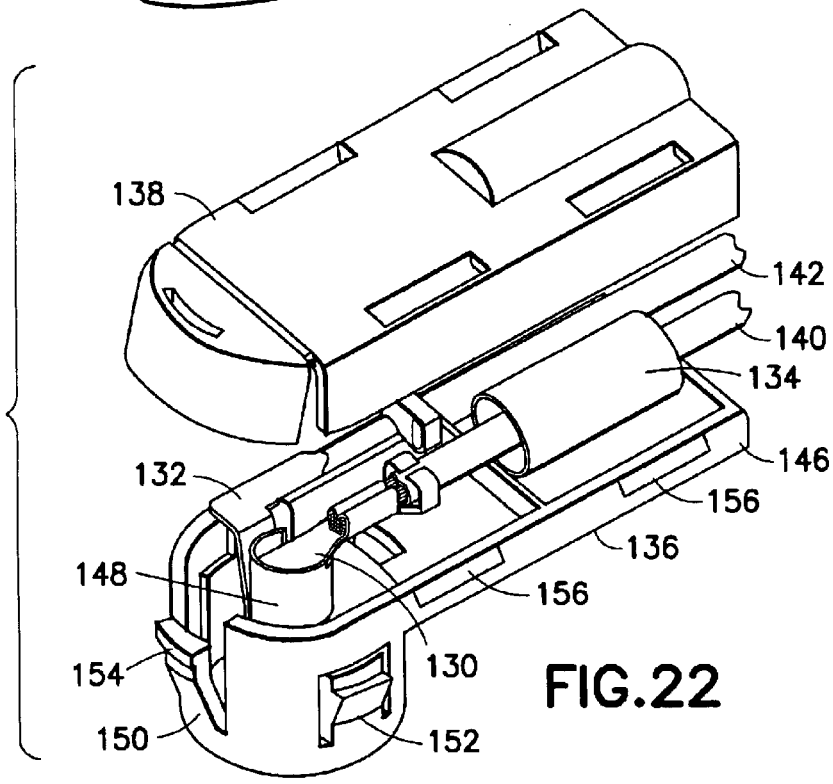
FIG. 22 is a perspective view of the electrical connector shown in FIG. 21 with the cover in an exploded position.
Figure 23:
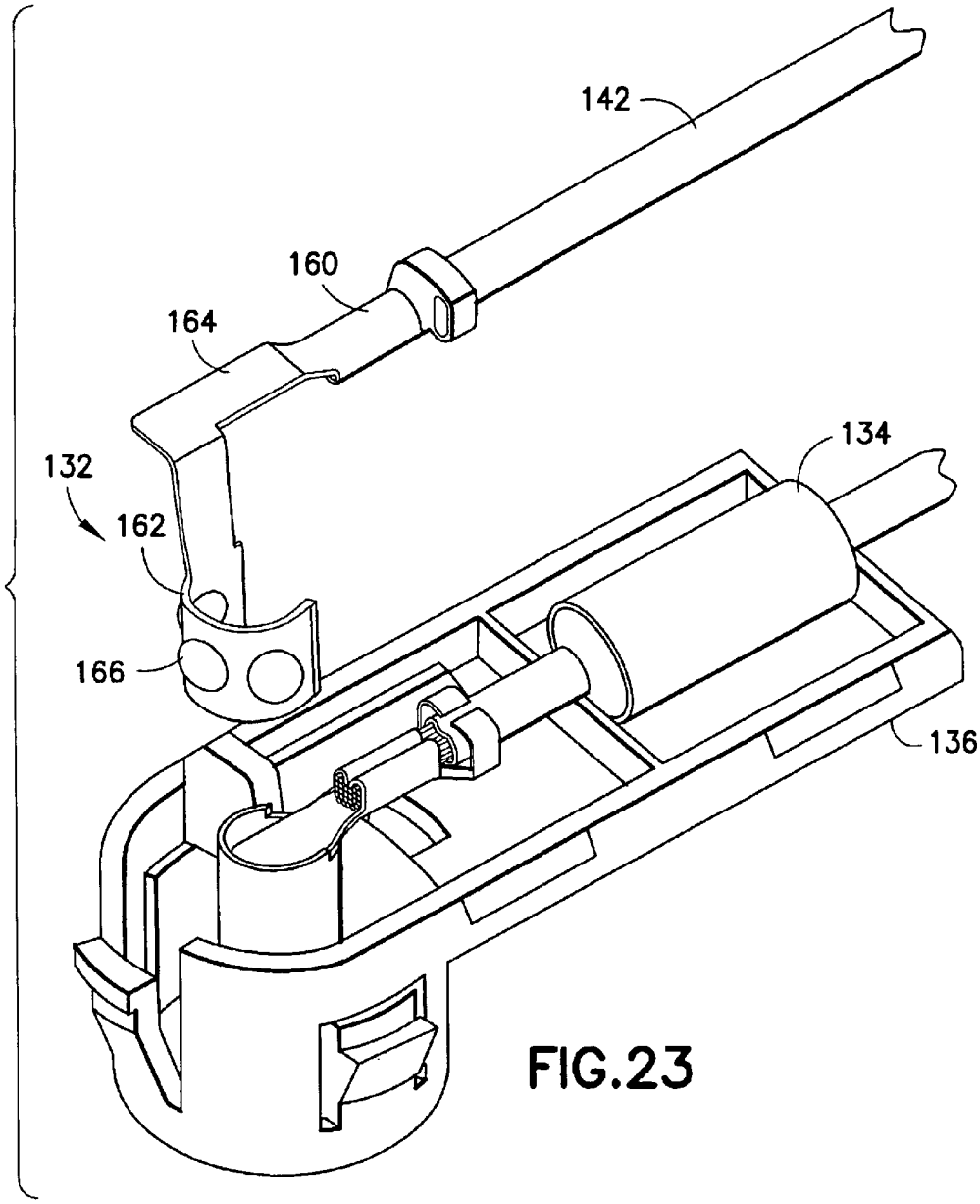
FIG. 23 is a perspective view of the electrical connector shown in FIG. 21 without the cover and showing the ground contact in an exploded position.
Figure 24:
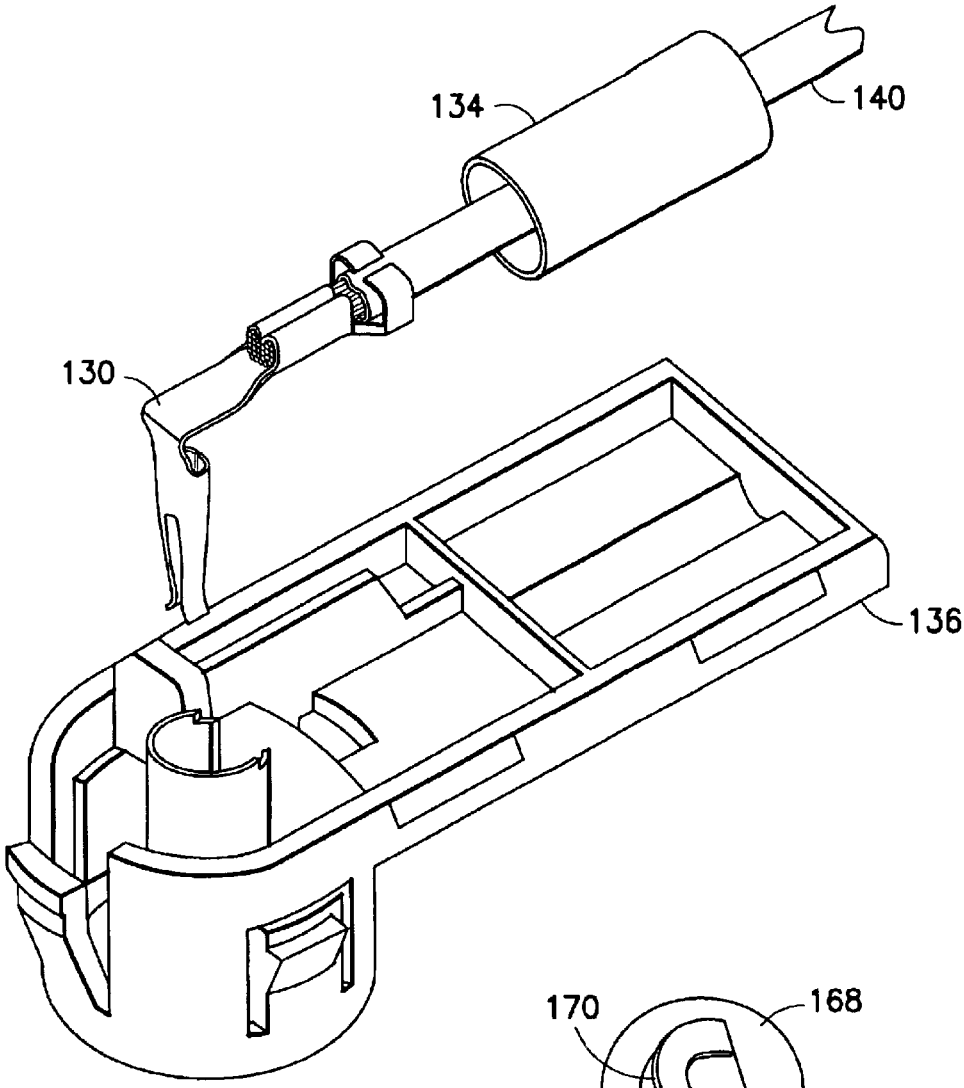
FIG. 24 is a perspective view of the electrical connector as shown in FIG. 23 with the ground contact removed and the power contact in an exploded position.

Referring also to FIGS. 22–24, the electrical connector 112 generally comprises a housing 128 (see FIG. 21), two electrical contacts 130, 132, and a ferrite member 134. The electrical connector 112 is adapted to connect two electrical conductors 140, 142 to contacts in the mating electrical connector 114. The housing 128 comprises a main member 136 and a cover 138. The main member 136 is preferably comprised of molded plastic or polymer material. The main member 136 comprises a first section 144 and a second section 146. The first section 144 is sized and shaped to be inserted into the receiving areas 122, 124 of the mating electrical connector. The first section 144 comprises a center tube section 148 and an outer ring section 150. The outer ring section 150 comprises two cantilevered deflectable side latches 152 on opposite sides of the outer ring section and a cantilevered deflectable connector position assurance (CPA) latch 154. The second section 146 of the main member 136 comprises an area for receiving ends of the conductors 140, and the ferrite member 134. The second section 146 comprises snap lock sections 156 for snap lock connecting the cover 138 to the main member 136.

Referring particularly to FIG. 23, the second electrical contact 132 forms a ground terminal for the connector. The ground terminal 132 generally comprises a one-piece member. Contact portions of the ground terminal 132 could be plated with a suitable plating material. The one-piece member is preferably formed from sheet metal which has been stamped and formed into the shaped shown. The ground terminal 132 generally comprises a first connection section 160 and a second connection section 162. The first connection section 160 is provided for connecting the terminal to the second electrical conductor 142. In the embodiment shown, the first connection section 160 is adapted to be compressed or crimped onto the conductor 142. However, any suitable type of connection between the terminal and the electrical conductor 142 could be provided.

The second connection section 162 is connected to the first connection section 160 by a bridging section 164. As seen in FIG. 24, the first contact 130 forms a power terminal which has a connection section that can be located inside the tube section 148. Thus, the mounting section 40 can be used to provide an insulation barrier between the terminals 130, 132.

The second connection section 162 comprises a general C shaped profile or cross-section. The second connection section 162 includes outwardly extending protrusions 166. In the embodiment shown, the second connection section 162 comprises three of the protrusions 166. In an alternate embodiment, more or less than three protrusions could be provided. The protrusions 166 are spaced from each other along the outer side of the second connection section 162. The protrusions extend radially outward relative to a center axis of the general C shaped section.

In the embodiment shown, the protrusions 166 are comprise a general rounded hill shape. However, in alternate embodiments, the protrusions 166 could comprise any suitable type of shape. For example, the front facing sides of the hill shapes could comprise elongated slopes to help with insertion of the front end of the connector 112 into an initiator. In order to form the protrusions 166 the sheet metal material of the second connection section 162 is stamped in an outward direction to form outward deformations of the sheet metal. Thus, recesses are formed under the outwardly extending hill shapes. After the second connection section 162 is mounted to the housing, the second connection section has its outer side freely exposed. Because it is a ground contact, the contact 132 does not need to be covered by the housing and the mating connector of the gas generator initiator can cover the second connection section 132 when it is inserted into the mating connector of the gas generator initiator.

The natural shape of the second connection section 162 is preferably sized and shaped to be snap lock mounted or slide into a groove in the tube section 148. The second connection section 36 is preferably slightly larger than the outer diameter of the tube section 148 such that a gap is formed therebetween. This allows the second connection section 162 to be able to move relative to the tube section 148. More specifically, the second connection section 162 is adapted to be compressed in an inward direction inside the groove portion of the tube section 148 and, thus, is adapted to reduce the inner diameter of the second connection section 162. This feature allows the second connection section to be slightly compressed when the front end of the connector 112 is inserted into a gas generator initiator. This allows the second connection section 162 to form a better electrical connection with the mating connector contact 120 in the gas generator initiator. The ability of the second connection section 162 to deflect inwardly also helps to prevent damage to the ground contact in the mating electrical connector.

The coaxial nature of the contacts 130, 132 in the connector 112 also helps to reduce the size of the connector. The connector 112 can be used with a mating connector 114 which comprises only a single pin contact 118 rather than a conventional double parallel pin air bag connector. Thus, the single pin design feature of the present invention can allow for a smaller packaging size for the connector.

Figure 25:
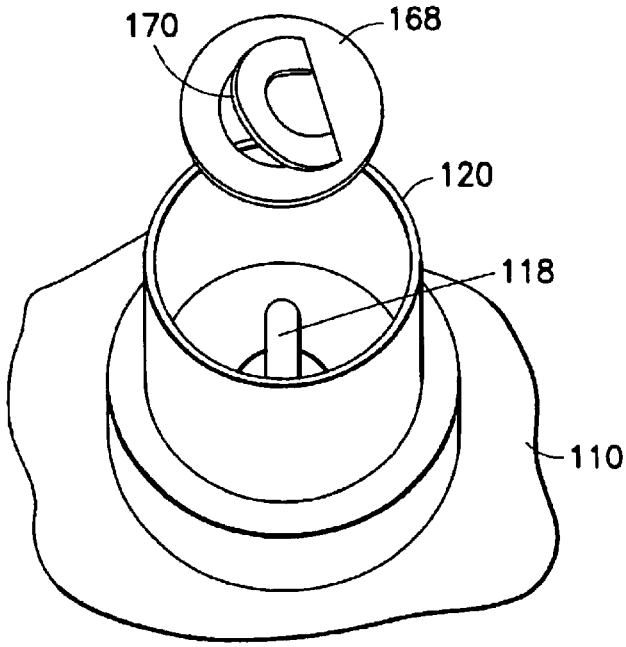
FIG. 25 is a perspective view of a portion of the mating electrical connector used in the air bag assembly with its shorting clip shown in an exploded position.

Referring also to FIG. 25, the mating electrical connector comprises a shorting clip 168. The shorting clip 168 connects the two coaxial contacts 118, 120 to each other. When the electrical connector 112 is connected to the mating electrical connector 114, the front end of the tube section 148 contacts the deflectable section 170 of the shorting clip 168 to move the deflectable section 170 and disconnect the deflectable section 170 from the power contact pin 118 and, thereby disrupting the electrical connection between the two contacts 118, 120.

The cover 138 of the housing 128 is preferably comprised of molded plastic or polymer material. The cover 138 is snap lock connected to the main member 136. The cover 138 includes a main section 172 and a CPA section 174. The CPA section 174 is connected to the main section 172 by a living hinge 176. Thus, the CPA section 174 is pivotably attached to the main section 172. As seen in FIG. 21, before the electrical connector 112 is attached to the mating electrical connector 114 the CPA section 174 is located at an open position. A bottom side of the CPA section 174 contacts a top side of the CPA latch 154. The CPA latch 154 prevents the CPA section 174 from being moved to a closed position.

Figure 26:
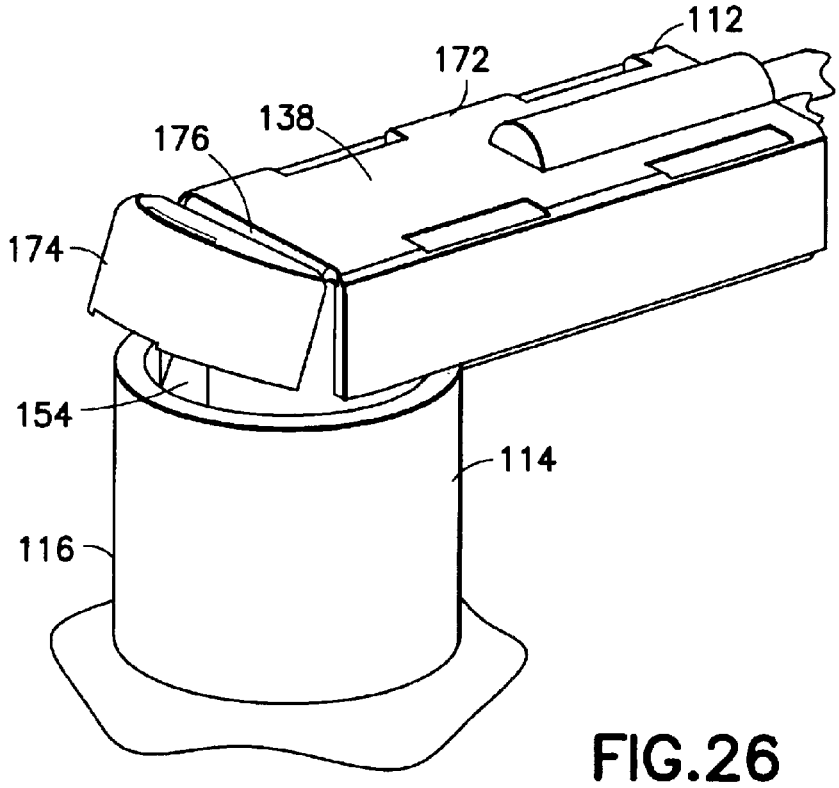
FIG. 26 is a perspective view of the electrical connector shown initially inserted into the mating connector of the air bag assembly.
Figure 27:
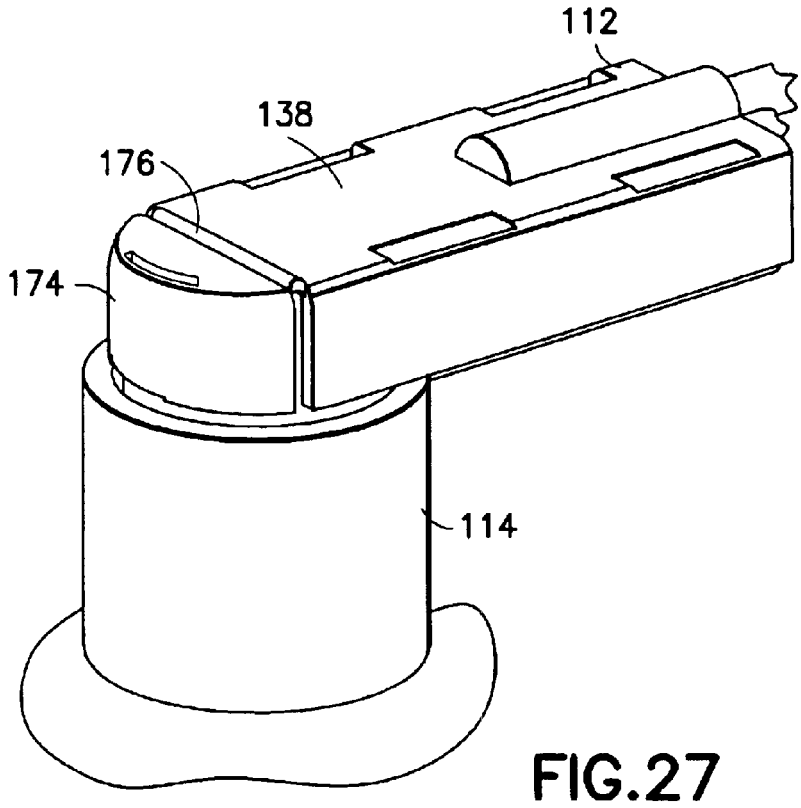
FIG. 27 is a perspective view of the electrical connector and mating connector shown in FIG. 26 with the CPA member moved to a latched position.

When the electrical connector 112 is connected to the mating electrical connector 114, as shown in FIG. 26, the side latches 152 engage the housing 116 to latch the two housings 116, 128 together. The CPA latch 154 is deflected in an inward direction by contact with the housing 116 of the mating electrical connector. This moves the CPA latch 154 out of the path of the bottom side of the CPA section 174. As seen in FIG. 27, the CPA section 174 can now be moved to a closed or latched position. The outer side of the CPA latch 154 comprises a latch to engage an inside surface latch of the CPA section 174 to maintain the CPA section 174 in its closed and latched position. Unless the first section 144 of the main member 136 is fully inserted into the outer receiving area 124 of the mating connector's housing 116, the CPA latch 154 prevents the CPA section 174 from being moved to its closed latched position. Thus, a user automatically knows that the electrical connector 112 is not in a properly inserted position unless the CPA section 174 can be moved to its closed and latched position.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

housing having a receiving area extending into a first side for receiving a portion of a mating connector and an opposite second side; and coaxial electrical contacts connected to the housing, wherein the housing comprises ribs projecting inwardly into the receiving area in a general cantilever fashion, the ribs being adapted to allow the housing to be mated to the mating connector in at least two orientations and, when the electrical connector is attached to the mating connector, to prevent rotation of the housing relative to the mating connector.

2. An electrical connector as in claim 1 wherein the housing comprises pull-test handles extending laterally outward from the housing.

3. An electrical connector as in claim 1 further comprising a connector position assurance (CPA) member movably attached to the housing, wherein the CPA member extends outward from the second side, wherein the CPA member comprises a portion adapted to contact a section of a second one of the electrical contact to move the section when the CPA member is moved from unlatched position in a direction towards the second side and towards a latched position.

4. An electrical connector as in claim 3 wherein the section of the second electrical contact comprise a deflectable cantilevered bar which contacts an underside of a first one of the electrical contacts.

5. An electrical connector as in claim 1 further comprising a connector position assurance (CPA) member movably attached to the housing, wherein the housing comprises stops which engage locating arms of the CPA member when the CPA member is in an unlatched position and prevent the CPA member from being moved to a latched position, and wherein the locating arms are adapted to be moved by a portion of the mating connector when the electrical connector is connected to the mating electrical connector such that the locating arms can be moved past the stops of the housing to the latched position.

6. An electrical connector as in claim 5 wherein the housing comprises deflectable locking arms adapted to engage the portion of the mating connector to latch the housing to the mating connector, wherein the locking arms each comprise a slot for the locating arms to slide along, and wherein the stops are located at bottom portions of the slots.

7. An electrical connector as in claim 1 wherein a second one of the electrical contacts comprises a first connection section for connecting the second contact to an electrical conductor, and a second connection section connected to the first connection section for removably electrically connecting the second contact to a mating terminal in the mating electrical connector, the second connection section comprising at least two cantilevered sections with protrusions, the protrusions forming outwardly facing contact surfaces for the second connection section.

8. An electrical connector as in claim 7 wherein the second connection section comprises at least three of the cantilevered sections, each one of the cantilevered sections having one of the protrusions, and wherein the protrusions are spaced from each other.

9. An electrical connector as in claim 7 wherein the protrusions each comprise a generally rounded hill shape.

10. An electrical connector as in claim 1 wherein the ribs comprise at least one orientation polarizing rib which is different than at least one of the other ribs.

11. An electrical connector as in claim 10 wherein the ribs allow the housing to be mated to the mating connector in only two of the orientations.

12. An electrical connector as in claim 10 wherein the ribs comprise at least one orientation polarizing rib which is different than at least one of the other ribs.

13. An electrical connector as in claim 12 wherein the ribs allow the housing to be mated to the mating connector in the only two of the orientations.

14. An electrical connector comprising:

a housing having a first side with a generally ring shaped receiving area for receiving a portion of a mating connector, and an opposite second side; and coaxial electrical contacts connected to the housing, wherein the housing comprises an inwardly projecting snap latch which is adapted to project into the mating connector and latch behind an outwardly projecting rim of a retainer of the mating connector located in the receiving area.

15. An electrical connector as in claim 14 wherein the housing comprises pull-test handles extending laterally outward from the housing.

16. An electrical connector as in claim 14 further comprising a connector position assurance (CPA) member movably attached to the housing, wherein the CPA member extends outward from the second side, and wherein the CPA member comprises a portion adapted to contact a section of a second one of the electrical contacts to move the section when the CPA member is moved in a direction into the second side from an unlatched position to a latched position.

17. An electrical connector as in claim 16 wherein the section of the second electrical contact comprises a deflectable cantilevered bar which contacts an underside of a first one of the electrical contacts.

18. An electrical connector as in claim 14 further comprising a connector position assurance (CPA) member movably attached to the housing, wherein the snap latch comprises two latch arms, each latch arm comprising a stop which engages locating arms of the CPA member when the CPA member is in an unlatched position and prevent the CPA member from being moved to a latched position, and wherein the locating arms are adapted to be moved by the rim of the mating connector when the electrical connector is connected to the mating electrical connector such that the locating arms can be moved past the stops of the housing to the latched position.

19. An electrical connector as in claim 18 wherein the snap latch comprises deflectable locking arms adapted to engage the rim of the mating connector to latch the housing to the mating connector, wherein the locking arms each comprises a slot for the locating arms to slide along, and wherein the stops are located at bottom portions of the slots.

20. An electrical connector as in claim 14 wherein a second one of the electrical contacts comprises a first connection section for connecting the second contact to an electrical conductor, and a second connection section coupled to the first connection section for removably electrically connecting the second contact to a mating terminal in the mating electrical connector, the second connection section comprising at least two cantilevered sections with protrusions, the protrusions forming outwardly facing contact surfaces for the second connection section.

21. An electrical connector as in claim 20 wherein the second connection section comprises at least three of the cantilevered sections, each one of the cantilevered sections having one of the protrusions, and wherein the protrusions are spaced from each other.

22. An electrical connector as in claim 20 wherein the protrusions each comprise a generally rounded hill shape.

23. An electrical connector comprising:

a housing having cantilevered deflectable locking arms;

coaxial electrical contacts connected to the housing; and a connector position assurance (CPA) member movably attached to the housing, the CPA member having inwardly projecting locating arms in contact with the locking arms, wherein the locking arms prevent the locating arms from moving from a first up position to a second down position unless the locking arms are at a fully connected position on a retainer rim with a mating connector.

24. An electrical connector as in claim 23 wherein the housing comprises ribs projecting inwardly into the receiving area, the ribs being adapted to allow the housing to be mated to a mating connector in at least two orientations and, when the electrical connector is attached to the mating connector, to prevent rotation of the housing relative to the mating connector.

25. An electrical connector as in claim 23 wherein the CPA member comprises a portion adapted to contact a section of a second one of the electrical contacts to move the section when the CPA member is moved from the first up position towards the second down position, and wherein the section of the second electrical contact comprises a deflectable cantilevered bar which contacts an underside of a first one of the electrical contacts.

26. An electrical connector as in claim 23 wherein a second one of the electrical contacts comprises a first connection section for connecting the second contact to an electrical conductor, and a second connection section coupled to the first connection section for removably electrically connecting the second contact to a mating terminal in the mating electrical connector, the second connection section comprising at least three cantilevered sections with protrusions, the protrusions forming outwardly facing contact surfaces for the second connection section.

27. An electrical connector as in claim 23 wherein each locking arm comprising a stop which engage the locating arms of the CPA member when the CPA member is in the first up position and prevent the CPA member from being moved to the second down position, and wherein the locating arms are adapted to be moved by the rim of the mating connector when the electrical connector is connected to the mating electrical connector such that the locating arms can be moved past the stops of the locking arms,to the second down position.

28. An electrical connector as in claim 27 wherein the locking arms are deflectable and are adapted to engage behind the rim of the mating connector to latch the housing to the mating connector, wherein the locking arms each comprises a slot for the locating arms to slide along, and wherein the stops are located at bottom portions of the slots.

29. An electrical connector comprising:

a housing having a main section and a cover, the main section being adapted to be inserted into a receiving area of a mating electrical connector, the main section comprising a cantilevered deflectable connector position assurance (CPA) latch and the cover comprising a CPA section movably attached to a main section of the cover by a living hinge; and coaxial electrical contacts connected to the main section of the housing, wherein the CPA latch prevents the CPA section of the cover from moving to a closed latched position unless the CPA latch is moved inward by the mating electrical connector when the CPA latch is inserted into the receiving area of the mating electrical connector.

30. An electrical connector assembly comprising:

a first socket electrical connector comprising a first housing with a plug receiving area and first electrical contacts, wherein a portion of the first housing is located in the plug receiving area and comprises a first ring of outwardly extending ribs; and a second plug electrical connector comprising:

a second housing having a portion receiving area extending into a first side for receiving the portion of the first housing; and second electrical contacts connected to the second housing, wherein the second housing comprises a second ring of ribs projecting inwardly into the portion receiving area and adapted to project between the ribs of the first housing, wherein the ribs are adapted to allow the second housing to be mated to the first housing in at least two orientations and, when the second plug electrical connector is attached to the first socket electrical connector, to prevent rotation of the housings relative to each other.

31. An electrical connector comprising:

a housing having a projecting section with a generally ring shaped receiving area for receiving a portion of a mating electrical connector; and coaxial electrical contacts connected to the housing, wherein a second outer one of the electrical contacts comprises a first connection section for connecting the second contact to an electrical conductor, and a second connection section coupled to the first connection section for removably electrically connecting the second contact to a mating terminal of the mating electrical connector, wherein the second connection section extends into the ring shaped receiving area and comprises at least one cantilevered section with contact surfaces extending laterally outward into the ring shaped receiving area for connection to an inner lateral side of the mating terminal of the mating electrical connector when the electrical connector is inserted into the mating electrical connector.

32. An electrical connector as in claim 31 wherein the contact surfaces are spaced from a bottom leading end of the at least one cantilevered section.

33. An electrical connector as in claim 31 wherein the contact surfaces each comprise a general hill shaped protuberance.

* * * * *